US007267734B2

(12) United States Patent
Evans et al.

(10) Patent No.: US 7,267,734 B2
(45) Date of Patent: Sep. 11, 2007

(54) ALUMINUM ALLOY SHEET

(75) Inventors: Paul Vincent Evans, Deddington (GB); Theodor Rottwinkel, Adelebsen (DE); Jeremy Mark Brown, Banbury (GB)

(73) Assignee: Novelis Inc., Toronto (CA)

( * ) Notice: Subject to any disclaimer, the term of this patent is extended or adjusted under 35 U.S.C. 154(b) by 512 days.

(21) Appl. No.: 10/726,181

(22) Filed: Dec. 1, 2003

(65) Prior Publication Data

US 2004/0108021 A1 Jun. 10, 2004

Related U.S. Application Data

(62) Division of application No. 09/980,886, filed as application No. PCT/GB00/02026 on May 26, 2000, now abandoned.

(30) Foreign Application Priority Data

May 27, 1999 (EP) ..... 99304141

(51) Int. Cl.
*C22F 1/04* (2006.01)

(52) U.S. Cl. ..... 148/552; 148/551

(58) Field of Classification Search ..... 148/551, 148/552

See application file for complete search history.

(56) References Cited

U.S. PATENT DOCUMENTS 4,049,248 A 9/1977 Gjosteen et al.
5,350,010 A 9/1994 Sawada et al.
5,711,827 A * 1/1998 Sawada et al. ..... 148/552

FOREIGN PATENT DOCUMENTS

| | | |
|---|---|---|
| EP | 0097318 | 1/1984 |
| EP | 0581321 | 2/1994 |
| EP | 0672759 | 9/1995 |
| WO | 9011382 | 10/1990 |

OTHER PUBLICATIONS

"The effect of process parameteres on the fir-tree structure in DC-cast rolling ingots", Brusethang et al., 8th ILMT, 1987, Leobe Vienna, pp. 472-476.*

"ASM Handbook: Casting", vol. 15, ASM International, 1988, pp. 313-314.

Brusethaug et al., "The effect of process parameters on the fir-tree structure in DC-cast rolling ingots", (1987) pp. 472-476.

* cited by examiner

*Primary Examiner*—Roy King
*Assistant Examiner*—Janelle Morillo
(74) *Attorney, Agent, or Firm*—Cooper & Dunham LLP

(57) ABSTRACT

An aluminium alloy sheet suitable for use as lithographic plate support, wherein the aluminium alloy has the composition (in wt. %): Si 0.05-0.20 preferably 0.06-0.14; Fe 0.15-0.40 preferably at least 0.2; others up to 0.05 each and up to 0.15 total; Al balance, wherein the aluminium alloy sheet is non-grain refined.

8 Claims, No Drawings

ALUMINUM ALLOY SHEET

CROSS REFERENCE TO RELATED APPLICATION

This application is a division of U.S. patent application Ser. No. 09/980,886 filed Feb. 8, 2002 now abandoned, as the U.S. national stage of international application No. PCT/GB00/02026 filed May 26, 2000.

This invention is concerned with aluminium alloy sheet suitable for electrograining to provide lithographic plate support. An alloy substantially used for the purpose is AA1050A. Care needs to be exercised over many aspects of the conversion from molten metal to rolled sheet, in order to achieve a satisfactory graining response free of surface defects of various kinds, when the sheet is subjected to graining, particularly electrograining, particularly in nitric acid electrolyte. This invention is concerned with sheet having a good graining response, and with a method of its production in an economical manner.

EP-A-0581321 discusses a method of producing planographic printing plate support in which after aluminium is continuously cast directly from molten aluminium into a thin plate, the plate is subjected to cold rolling, heat treatment, flattening and subsequently roughening. The components of the aluminium support are 0.4% -0.2% Fe, 0.20% -0.05% Si, not greater than 0.02% Cu and an Al purity of not smaller than 99.5%. The cast product has a grain size of 2 to 500 μm.

EP-A-0672759 discloses a support for a planographic printing plate comprising $0<Fe\leqq 0.2$ wt %, $0\leqq Si\leqq 0.13\%$, $99.7\% \leqq Al$, and the balance of inevitable impurities.

S Brusethaug (special print of the documentation of 8th ILMT, 1987, Loeben—Vienna) discloses the effect of process parameters on the fir-tree structure in DC-cast rolling ingots. The document discloses a casting speed of 90 mm/min and Fe/Si ratio of 2 in the composition. Degassing before casting is not discussed.

Light Metals 1999, pp 749 to 754 (Furu) discloses the effect of as-cast microstructure and subsequent processing on banding in rolled Al-sheets. This discusses the fir-tree problem and the various grain refining practices used relating to changing the B:Ti ratio.

In one aspect the invention provides aluminium alloy ingot suitable for rolling to sheet for use as lithographic plate support, wherein the aluminium alloy has the composition (in wt %)

| | |
|---|---|
| Si | 0.05-0.20 preferably 0.06-0.14 |
| Fe | 0.15-0.40 preferably at least 0.2 |
| Others | up to 0.05 each and up to 0.15 total |
| Al | balance |

wherein the aluminium alloy ingot is non-grain-refined.

The Fe/Si weight ratio may be from 2.5 to 5.5, preferably 2.5 to 4.9. The upper limit of the Fe/Si ratio is even more preferably 4.5.

The Si content is even more preferably 0.08-0.10.

The Fe content is even more preferably 0.25-0.4 and even more preferably 0.25-0.35.

Preferably the primary aluminium used in this alloy is 99.5% pure. This grade is readily available commercially and cheaper than the higher grades such as 99.7%. Primary aluminium invariably contains iron, which arises as a natural impurity in the smelting process. It is very insoluble in solid aluminium, and is primarily present in the cast structure as second phase intermetallic particles. The greater the amount of iron in the alloy, the greater the volume fraction and number density of these intermetallic phases. In order to provide 0.15 to 0.40 preferably 0.25 to 0.35 wt % of iron, it is usually necessary to make a small addition of iron to the base smelter metal. The level of iron is desirable for three reasons. First, it provides a sufficient number of coarse particles to provide nucleation sites during subsequent recrystallisation during thermomechanical processing,—promoting random texture components. Second, although the majority of the iron is present as coarse particles, it guarantees that a sufficiently high level of iron is achieved in solid solution in the centre of each dendrite so that it is significantly super-saturated at an interannealing temperature; consequently, the structure is able to achieve a constant level of iron in solution by precipitate nucleation and growth at all points in the structure during inter-annealing. Since the primary factors controlling electro-graining response are known to be the combined effects of the various elements in solid solution, this helps guarantee a constant electro-graining response at all positions across the grains. Thirdly, the uniform level of iron in solution following inter-annealing renders the microstructure less likely subsequently to undergo localised recrystallisation, and hence softening and distortion, when the final gauge product is exposed to a plate baking process.

Silicon also occurs as a natural impurity in the smelting process, typically at levels around 0.05 wt % or less. To provide a silicon level of 0.05 to 0.20 preferably 0.06 to 0.14 wt %, silicon may be deliberately added to smelter metal. Unlike iron, silicon is moderately soluble in solid aluminium, and is able to diffuse rapidly. At the end of solidification, the majority of silicon in the alloy is present in solid solution. The levels of silicon and iron are chosen to optimise the electrograining response at final gauge. However, there are implications from this choice for both grain refining and casting practices.

The Fe/Si weight ratio of the alloy is in the range 2.5 to 5.5, preferably 2.5 to 4.9, for example with a maximum of 4.5, as the electro-graining response is may be inferior outside this range.

Hydrogen is virtually insoluble in solid aluminium: the gas content in the alloy partitions strongly to the residual liquid during solidification, where it can nucleate bubbles and cause porosity in the casting. At the gas levels commonly achieved in commercial practice, it is believed that the porosity is usually micro-porosity, along the boundaries between grains or cells or dendrites. The microporosity may develop during reheating after casting. The inventors believe that excessive microporosity generates unacceptably streaky electro-grained surfaces. The maximum hydrogen gas level that can be accommodated in the melt depends on the grain structure in the casting as discussed below. If the hydrogen content of the molten metal is too high, then this can lead to the formation of microporosity at grain boundaries. If the grains are coarse, as in a non-grain-refined ingot, the distribution of the porosity is sufficiently coarse that the electro-graining defect results. Hydrogen content of the melt can be reduced by degassing the melt shortly before casting.

Aluminium sheet for use as lithographic plate support is grain refined, and there are two main reasons for this. The primary reason for the addition of grain refiner to lithographic sheet ingots is to generate a uniform distribution of equiaxed small (about 100 μm) randomly oriented grains at the scalp depth.

An additional related reason for using grain refiner also concerns porosity. In addition to ensuring a fine, random distribution of grains, the increase in grain boundary surface area per unit volume of a casting (that results from the use of grain refiner) also has the benefit of refining the distribution of micro-porosity in the casting (compared to a non-grain refined casting with the same hydrogen level). As discussed above, excessive microporosity results in an unacceptably streaky final gauge electro-grained product. Consequently, a grain refined microstructure can tolerate a higher level of hydrogen than a non-grain refined structure.

In the absence of grain refiner, or when the grain refiner is ineffective (for example where insufficient refiner is added or it is ineffective due to the temperature being too high, or the contact time being too long or to elements being present, such as Zr, which poison the grain refiner), very coarse grains are produced that may be feather and twinned or columnar. The presence of such grains has previously been thought to lead to the formation of a defect (streaking) during electrograining of the final gauge sheet. However, the present inventors have determined that a coarse grain structure is not in itself detrimental to final gauge electrograining response.

Three forms of growth morphology are observed in direct chill (DC) cast aluminium ingots, commonly referred to as equiaxed, columnar and feather. Fine equiaxed grains dominate in well grain refined material. Where the ingot has not been grain refined, the columnar and feather growth forms compete with each other. Which dominates, and hence which is observed in the cast ingot, depends on a number of factors including thermal gradient and alloy composition, the feather form tending to be observed at higher thermal gradients and concentrations of alloying elements. Both growth forms lead to a relatively coarse grain structure in the cast ingot.

The aluminium ingot of the present invention preferably contains feathery or columnar grains or any combination of the two, and the grain size may be greater than 500 μm measured in the longest direction.

For the columnar mode of growth, the grains which develop comprise an array of dendrites which have grown in the direction of the local heat flow, the axes of the dendrites being parallel to the <100> crystallographic directions of the aluminium. Feather crystals (i.e. grains) on the other hand (so called because of their characteristic shape) comprise an array of parallel, twinned lamellae containing alternate coherent and incoherent boundaries and typically spaced about 100 μm apart. This type of twinning is highly characteristic and is not present in any other type of grain in DC cast material. (Due to the presence of this twinning, the terms feather crystals/grains/growth are often used interchangeably with twinned crystals/grains/growth.)

Feathery 'grains' can be several cm in size. (Grain size referred to here is generally measured on an ingot section in a plane transverse to the casting direction). For sheet ingot, in the region of the scalping zone, the smallest may be about 3 or 4 cm. In an extreme case feathery grains can grow from the shell zone boundary to the ingot centre across the full ingot width. For columnar grains, the cross section can range from in the order of 100 μm to several mm, say about to 5 mm. In terms of length, anywhere from about 0.5 mm to several cm. Columnar grains typically have an aspect ratio (length to width) of at least 2 and more often greater than 5. In non-grain refined ingot, columnar grain may exist within the shell zone, i.e. up to about 1-1.5 cm in length, and perhaps beyond the shell zone.

Casting of the alloy is often effected by DC casting. Casting speed influences the local solidification velocity and cooling rates. This parameter has little impact on the solid solution levels achieved in the casting (in the range of practically attainable DC casting speeds), but can have a dramatic effect on the intermetallic phases. In this alloy system, the equilibrium phase is usually monoclinic $Al_{13}Fe_4$, (depending on the exact composition). However, at modest solidification rates, it is replaced by various metastable phases, such as orthorhombic $Al_6Fe$ and tetragonal $Al_mFe$ (the exact value of "m" is unclear, but probably about 4.5). As the rate of solidification diminishes with distance into an ingot, it is possible to achieve a spatial transition from one metastable phase to another. The transition from $Al_6Fe$ to $Al_{13}Fe_4$ is very gradual and does not normally present problems. By comparison, the transition from $Al_6Fe$ to $Al_mFe$ is much sharper and generates a non-planar highly variable macroscopic interface between regions each containing, predominantly one phase. If scalping results in adjacent regions of different phase type being exposed on the surface, a final gauge electro-graining defect is again found. The region containing $Al_mFe$ is frequently referred to as a "fir tree zone" (from the characteristic etching pattern seen on a vertical section of the ingot). Consequently, the casting practice is chosen to avoid the danger of forming $Al_mFe$ at the scalp depth in the ingot. For a given composition of iron and silicon, and in a grain-refined alloy, there is found to be a critical casting speed above which $Al_mFe$ will form. As the silicon level is increased, this critical speed is reduced. By casting at speeds below the critical value, the formation of the detrimental fir tree zone is avoided. Hence the compositions of the present invention preferably do not contain $Al_mFe$.

However, the formation or otherwise of the $Al_mFe$ phase is not dictated by casting speed alone. It is known that the ingot must also be grain-refined for this phase to appear (the reasons for this are not fully understood). The maximum possible casting speeds (to avoid fir tree structure at scalp depth) in a grain-refined aluminium alloy are inconveniently slow. It is an object of this invention to permit aluminium alloy ingots suitable for rolling to sheet for use as lithographic plate support, to be cast at higher casting speeds than have generally hitherto been possible.

A step towards achieving that object is taken by using for the purpose an aluminium alloy that is non-grain-refined. Grain refining is a matter of degree, and it appears that the amount of grain refiner needed to trigger the formation of an $Al_mFe$ phase is equal to or more than the amount needed to achieve a significant grain-refining effect. For reasons that are not fully understood, the formation of $Al_mFe$ appears to be encouraged by the presence of fine substantially equiaxed grains. Feathery or columnar grains or a combination of the two do not favour the formation of this phase. It is believed that the mere presence of grain refiner substances such as $TiB_2$ is not sufficient to encourage the formation of $Al_mFe$. The substances must be present in a sufficient amount and in conditions that give substantial grain refinement for this phase to appear at the casting speeds typically achieved in DC casting. In the invention, by non grain refined, we mean that the ingot has not been treated with a grain refiner and/or it has a grain structure wherein substantially all of the grains are feathery or columnar or a combination of the two. (In some instances equiaxed grains have been observed at the centre of non grain refined ingot but these play no part in the properties of the surface of the rolled sheet).

Smelter metal typically contains about 2 parts per million of boron. A non-grain-refined alloy would generally contain less than about 5 parts per million of boron; or would contain substantially no particles of a grain refiner such as titanium diboride or titanium carbide; or would not have received any significant grain refiner addition. Non grain refined ingot intended for use as litho sheet may contain less than 0.004% Ti, preferably less than 0.0030% Ti and probably below 0.0025% Ti. For comparison, such ingot after grain refining would usually contain 0.005% Ti or more.

Lithographic sheet ingots may be grain refined by the addition of about 0.5 to 2 kg of 3:1 Ti:B rod to the launder of the casting machine for each tonne of metal cast. Various other additions may be made. For example Ti waffle may be added to the furnace or AlTi5B1 rod may be added to the launder. Other grain refiners such as Al6Ti and those containing TiC may be used. Grain refining additions must be made in amounts sufficient to bring about adequate grain refining and under conditions that allow the grain refiner to be active.

While it permits an increase in the casting speed, the use of a non-grain-refined alloy requires that attention be paid to the hydrogen content of the metal. According to the present invention, the aluminium alloy ingot generally has a hydrogen content not greater than about 0.25 ml/100 g of metal, e.g. below 0.20 ml/100 g, preferably not more than 0.18 ml/100 g, ideally less than 0.15 ml/100 g. The hydrogen content of metal emerging from the furnace, prior to any in-line degassing, is typically 0.25-0.35 ml/100 g.

One method of reducing the amount of dissolved hydrogen in the furnace charge is to use furnace fluxing. A carrier gas (usually a nitrogen-chlorine mixture) is bubbled through the liquid metal along a lance. Hydrogen is transferred from the liquid metal into the carrier gas bubble as it passes through the metal. However, furnace fluxing cannot provide consistent and low hydrogen levels since hydrogen re-absorption is rapid once gas injection ceases. Hence, in order to achieve low levels of hydrogen in the molten metal prior to casting, in-line degassing is used.

In-line degassing operates on the molten metal as it is transferred via a launder from the furnace to the casting head. After passing through the degasser, the molten metal is exposed for only a relatively short time to the ambient atmosphere, hence the extent of hydrogen re-absorption is small. Again, hydrogen removal is via transfer into a carrier gas (argon-chlorine mixture) which is injected into the molten metal, this time using a rotor system which gives vigorous stirring and a fine bubble size, ensuring efficient hydrogen removal.

There are a number of commercial in-line degassing systems which are available, e.g. Alpur, SNIF, Hycast and ACD (Alcan Compact Degasser) (Trade Marks). The achievable hydrogen level at the outlet depends on the inlet hydrogen content in each case, but efficiencies typically lie in the range 50-60% and outlet hydrogen levels of 0.10-0.15 ml/100 g are common.

There are essentially two alternative methods of determining the hydrogen content of the molten metal prior to casting. First, a sample can be taken, solidified and then analysed using a laboratory instrument such as the LECO (Trade Mark). However, to obtain on-line information in a cast-shop setting, a probe is immersed in the molten metal. An inert carrier gas (nitrogen) is recirculated within the probe interior. Hydrogen is able to pass from the liquid metal to the carrier gas in the interior of the probe. Once equilibration has been achieved, the hydrogen content of the carrier gas is determined using a measurement of its electrical conductivity. From this, the hydrogen content of the metal can be deduced, once appropriate corrections have been made for alloy composition and temperature.

Measurement of hydrogen levels in solid samples is commonly done using the LECO instrument. A solid specimen of standard size and geometry is melted under a flowing nitrogen stream. Hydrogen passes from the now molten metal into the gas stream. Again, the hydrogen content of the sample is deduced from a measurement of the electrical conductivity of the carrier gas. The use of standard sample size and geometry is important as the method is sensitive to the surface to volume ratio due to contributions from moisture present at the sample surface.

The hydrogen content of rolled sheet is more difficult to measure directly. But rolled sheet derived from an ingot having a suitably low hydrogen content is characterised by being substantially free of microporosity, with any microporosity that may nevertheless be present not being sufficient to produce streaking defects during electrograining.

In order to make lithographic plate support, an alloy of the required composition may be first degassed and then immediately, before the molten is metal has a chance to react significantly with moisture resulting in raised hydrogen levels, cast. Casting is preferably done by a DC technique. With grain refiner absent, casting speed is not critical. To achieve high throughput and low costs, casting speed should be as fast as possible, with a maximum limit imposed by risk of run-out and safety and practical details rather than by metallurgical considerations. Preferred DC casting speeds are in excess of 55 mm/min, e.g. 60 to 100 mm/min particularly about 80 mm/min. The ingot may be homogenised. The rolling faces of the resulting ingot are scalped to remove surface roughness, shell zone and any undesirable grain structure typically to a depth of about 10 to 20 mm. The ingot is then rolled to a sheet, for example a lithographic sheet by hot and cold rolling, in conventional manner and with any desired interannealing steps inter alia to control the iron in solution to a preferred range of 0.0012-0.0060%, down to a desired final thickness typically in the range 0.1 to 0.75 mm. See Thermo Electric Power—a Hand for Metallurgists, F R Boutin, S Demarker and B Meyer—Vienna Conference 1981. The Fe content measured by this technique has to be corrected for the influence of Si and impurity elements.

The surface of the resulting sheet is roughened, e.g. by mechanical graining or more preferably by electrograining using a hydrochloric acid or more preferably a nitric acid electrolyte, to provide lithographic plate support. The roughened surface may be anodised, and then coated with a photochromic layer, in a manner not material to the present invention, to provide a lithographic plate. These form further aspects of the invention.

Thus, according to a further aspect of the invention, there is provided a DC cast material for use as lithographic plate support, comprising an aluminium alloy having the composition (in wt %)

| | |
|---|---|
| Si | 0.05-0.20 preferably 0.06-0.14 |
| Fe | 0.15-0.40 preferably at least 0.2 |
| Others | up to 0.05 each and up to 0.15 total |
| Al | balance |

wherein the aluminium alloy ingot is non-grain-refined.

The Fe/Si weight ratio may be from 2.5 to 5.5, preferably 2.5 to 4.9. The upper limit of the Fe/Si ratio is even more preferably 4.5.

EXAMPLE 1

Two 210 mm×86 mm ingots having the composition AA1050A (Al-0.3 wt % Fe-0.1 wt % Si) were DC cast at 80 mm/min without grain refiner and without in-line degassing. The ingots had a feathery grain structure in the bulk of the ingot with mixed columnar and equiaxed grains near the ingot surface. The feather grains were very large; some in excess of 40 mm in length×30 mm width and extending well into the region that was scalped prior to rolling. Intermetallic phases present were $Al_6Fe$ and $Al_3Fe$. $Al_mFe$ was not detected and there was no fir tree structure (based on observation of the etched ingot slice and the phase analysis). Hydrogen level in the ingots was 0.25 ml/100 g. One ingot was homogenised at 500° C. over 24 hours with a minimum of 4 hours at 500° C. and the other at 600° C. over 24 hours with a minimum of 4 hours at 600° C. Both were then hot and cold rolled to a thickness of 0.3 mm with an intermediate anneal at 2.2 mm and the sheet was electrograined in nitric acid. A streaky surface resulted.

EXAMPLE 2

High Speed Casting Example (Commercial Scale Trial)

Sheet ingots of aluminium alloy MA1050A with approximate dimensions 600 mm thick and 1300 mm wide were cast by the direct chill (DC) process in a commercial scale facility with no grain refiner added at any stage of the casting process. One ingot was cast at a speed of between 50-55 mm/min and six were cast at between 70-75 mm/min. In addition, one grain-refined ingot was cast at between 50-55 mm/min as a control sample.

In-line degassing was used to achieve a hydrogen content no greater than 0.15 ml/100 g for six of the ingots cast without grain refiner and the control ingot cast with grain refiner. For one of the ingots cast at the higher speed without grain refiner, the hydrogen content was (deliberately controlled to be) higher than 0.15 ml/100 g.

After casting, ingot slices were taken perpendicular to the casting direction and etched to reveal the grain structure of the non-grain-refined ingots. Since no grain refiner had been used in the casting process, the ingots exhibited a coarse grain structure, predominantly of the feather or twinned type, but also including some non twinned columnar grains. The grain size was as high as about 350 mm in some regions. In addition, microstructural investigations were conducted to determine the phase type of the intermetallic particles present in the as-cast microstructure. Only the $Al_{13}Fe_4$ and $Al_6Fe$ phases were detected at the scalp depth (about 20 mm), whereas none of the $Al_mFe$ phase could be found.

The ingots were scalped to a depth of about 20 mm and homogenised before being hot and cold rolled to a final gauge of about 0.3 mm. The cold rolled coils were annealed using a batch process at an intermediate gauge of 2.2 mm.

The final gauge sheets were electro-grained in nitric acid using standard commercial practice. Despite the high casting speed and the coarse, non-uniform grain structure in the starting ingots, the final gauge sheet was found to electro-grain uniformly with no appearance of streaking on the surface.

Analysis of the hydrogen levels in the as cast ingots is given in the following table:

| Variant | Number of ingots cast | Grain Refinement | Speed mm/min | $H_2$ in ml/100 g | Streaking on Electro-graining |
|---|---|---|---|---|---|
| 1 | 5 | No | 70-75 | 0.100-0.13 | No |
| 2 | 1 | No | 50-55 | 0.129 | No |
| 3 | 1 | No | 70-75 | 0.178 | No |
| 4 | 1 | Yes | 50-55 | 0.134 | No |

The non-grain refined material contained 0.003% Ti and 0.0002% B.

Although not demonstrated in this example, previous tests have shown that casting grain refined ingots at 75 mm/min inevitably results in a greater propensity to streaking in the electro-grained litho sheet.

EXAMPLE 3

Samples of 0.3 mm gauge sheet were produced from non-grain refined ingot as described in EXAMPLE 2. Pieces measuring about 300×210 mm were etched in Tucker's reagent (45% HCl, 15% $HNO_3$, 15% HF in $H_2O$) to reveal the grain structure. The pieces appeared very streaky on a macroscopic scale with some bands of grains several mm wide running along the full length of the sample. Despite this streaky appearance on etching, on electro-graining in nitric acid in the conventional way, the sheet samples appeared satisfactory with no sign of streaking. This is counter to the expected result that a banded grain structure would be associated with streaking on electro-graining.

The invention claimed is:

1. A method of producing an aluminium litho-graphic sheet which method comprises:

a) providing a molten body of an aluminium alloy of composition in wt %:

| | |
|---|---|
| Si | 0.05-0.20 |
| Fe | 0.25-0.40 |
| Others | up to 0.05 each and up to 0.15 total |
| Al | balance |

wherein the aluminium alloy melt is prepared without the addition of grain refiners, b) optionally degassing the molten body, c) direct chill (DC) casting the molten body to form a cast ingot, d) rolling the ingot to sheet, e) electrograining the rolled sheet.

2. A method of producing an aluminium litho-graphic sheet according to claim 1 such that the cast ingot has a hydrogen content of not more than 0.25 ml/100 g.

3. A method of producing an aluminium litho-graphic sheet according to claim 1, wherein the Fe/Si ratio is from 2.5 to 5.5.

4. A method of producing an aluminium litho-graphic sheet according to claim 1, wherein the DC casting speed is >60 mm/min.

5. A method of producing an aluminium litho-graphic sheet according to claim 1, wherein the cast ingot contains grains of a length >500 μm.

6. A method of producing an aluminium litho-graphic sheet according to claim 1, wherein the cast ingot contains substantially no $Al_mFe$.

7. A method of producing an aluminium litho-graphic sheet according to claim 1, wherein the iron in solution is 0.0018 to 0.0051 wt %.

8. A method of producing an aluminium litho-graphic sheet according to claim 1, wherein the electrolyte used for electrograining is nitric acid.

* * * * *